US009281149B2

(12) United States Patent
Fasano et al.

(10) Patent No.: US 9,281,149 B2
(45) Date of Patent: Mar. 8, 2016

(54) ARC SHIELD

(71) Applicants: Michael Fasano, Watertown, CT (US); Jianzhuan Lin, West Hartford, CT (US)

(72) Inventors: Michael Fasano, Watertown, CT (US); Jianzhuan Lin, West Hartford, CT (US)

(73) Assignee: Carling Technologies, Inc., Plainville, CT (US)

( * ) Notice: Subject to any disclaimer, the term of this patent is extended or adjusted under 35 U.S.C. 154(b) by 7 days.

(21) Appl. No.: 14/201,350

(22) Filed: Mar. 7, 2014

(65) Prior Publication Data

US 2014/0251959 A1 Sep. 11, 2014

Related U.S. Application Data

(60) Provisional application No. 61/774,299, filed on Mar. 7, 2013.

(51) Int. Cl.
*H01H 71/02* (2006.01)
*H01H 9/30* (2006.01)

(52) U.S. Cl.
CPC *H01H 71/02* (2013.01); *H01H 9/30* (2013.01)

(58) Field of Classification Search
CPC ..... H01H 9/0246; H01H 9/342; H01H 2009/0278; H01H 2009/0285; H01H 33/53; H01H 33/60; H01H 33/62; H01H 33/64; H01H 9/48
USPC ..... 218/77, 155, 156, 157; 335/201; 361/142, 634, 657, 658; 200/303–305
See application file for complete search history.

(56) References Cited

U.S. PATENT DOCUMENTS

| | | | | | |
|---|---|---|---|---|---|
| 3,422,235 | A | * | 1/1969 | Camp | 218/34 |
| 3,582,966 | A | | 6/1971 | Strobel | |
| 4,075,446 | A | | 2/1978 | Aadahl | |
| 4,510,360 | A | | 4/1985 | Golub | |
| 4,620,076 | A | * | 10/1986 | Mrenna et al. | 200/304 |
| 4,622,444 | A | | 11/1986 | Kandatsu et al. | |
| 4,774,390 | A | | 9/1988 | Lehman et al. | |
| 5,059,931 | A | | 10/1991 | Lesslie | |
| 5,753,877 | A | * | 5/1998 | Hartzel et al. | 218/157 |
| 5,753,878 | A | | 5/1998 | Doughty et al. | |
| 5,796,061 | A | * | 8/1998 | Fabrizi et al. | 218/157 |

FOREIGN PATENT DOCUMENTS

CN 202564095 U 11/2012

OTHER PUBLICATIONS

International Search Report & Written Opinion of the International Searching Authority Application No. PCT/US2014/021664 Completed: Jun. 2, 2014; Mailing Date: Jul. 8, 2014 8 pages.

* cited by examiner

*Primary Examiner* — Truc Nguyen
*Assistant Examiner* — William Bolton
(74) *Attorney, Agent, or Firm* — St. Onge Steward Johnston & Reens, LLC

(57) ABSTRACT

A circuit breaker includes a shielding component having an external portion which defines a space external to the circuit breaker housing and covers a vent in the circuit breaker housing to direct gasses and debris from the vent to an outlet. The external portion also prevents insertion of the circuit breaker into a breaker box closer than the distances defining the space. This can have the advantage of preventing arcing from the breaker contacts to the breaker box. The external portion may also prevent insertion of the circuit breaker into a breaker box such that a vent in the circuit breaker housing is blocked. In some implementations, the shielding component contains an internal portion which extends into the circuit breaker housing and is disposed to impede debris generated by contact arcing, or other debris, from entering the mechanism of the circuit breaker.

31 Claims, 8 Drawing Sheets

ARC SHIELD

FIELD OF THE INVENTION

The invention relates to circuit breakers in general, and to a circuit breaker having an arc shield in particular.

BACKGROUND OF THE INVENTION

A circuit breaker is a device that can be used to protect an electrical circuit from damage caused by an overload or a short circuit. If a power surge occurs in a circuit protected by the circuit breaker, for example, the breaker will trip. This will cause a breaker that is in the "on" position to flip to the "off" position, and will interrupt the electrical power leading from that breaker. By tripping in this way a circuit breaker can prevent a fire from starting on an overloaded circuit, and can also prevent damage to the device that is drawing the electricity or to other devices connected to the protected circuit.

A standard circuit breaker has an input and an output. Generally, the input receives incoming electricity, most often from a power company. This is sometimes be referred to as the "line" terminal of the circuit breaker. The output, sometimes referred to as the "load" terminal, feeds out of the circuit breaker and connects to the electrical components being fed from the circuit breaker. A circuit breaker may protect an individual component connected directly to the circuit breaker, for example, an air conditioner, or a circuit breaker may protect multiple components, for example, household appliances connected to a power circuit which terminates at electrical outlets.

A circuit breaker can be used as an alternative to a fuse. Unlike a fuse, which operates once and then must be replaced, a circuit breaker can be reset (either manually or automatically) to resume normal operation. When the power to an area shuts down, an operator can inspect the electrical panel to see which breaker has tripped to the "off" position. The breaker can then be flipped to the "on" position and power will resume again.

In general, a circuit breaker has two contacts located inside of a housing which are used to make and break a connection between the line and the load. Typically, the first contact is stationary, and may be connected to either the line or the load. Typically, the second contact is movable with respect to the first contact, such that when the circuit breaker is in the "off," or tripped position, a gap exists between the first and second contact, and the line is disconnected from the load.

In circuit breakers that operate by separating contacts, the energized contacts separate when the circuit breaker is tripped, causing a gap to widen between the contacts while the movable contact moves from the closed position to the open position.

As the contacts begin to separate from a closed position, or complete closure from an open position, a very small gap exists between the contacts for a brief time while the contacts are closed or opened. An electric arc may be generated across this gap if the voltage between the contacts is high enough. This is because the breakdown voltage between the contacts is positively related to distance under pressure and voltage conditions in typical applications.

The creation of an arc during switching or tripping the circuit breaker can result in undesirable side effects which can negatively affect the operation of the circuit breaker, and which can create a safety hazard.

These effects can have consequences for the operation of the circuit breaker.

One possible consequence is that the arc may short to other objects in the circuit breaker and/or to surrounding objects, causing damage and presenting a potential fire or electrocution safety hazard.

Another consequence of arcing is that the arc energy damages the contacts, causing some material to escape into the air as fine particulate matter. The debris which has been melted off of the contacts can migrate or be flung into the mechanism of the circuit breaker, destroying the mechanism or reducing its operational lifespan.

Another effect of arcing stems from the extremely high temperature of the arc (tens of thousands of degrees Celsius) which can crack the surrounding gas molecules creating ozone, carbon monoxide, and other compounds. The arc can also ionize the surrounding gasses, potentially creating alternate conduction paths.

What is desired therefore, is a circuit breaker having an arc shield which addresses these limitations.

SUMMARY OF THE INVENTION

Accordingly, it is an object of the present invention to provide a circuit breaker having a shielding component.

It is another object of the present invention to provide a shielding component for a circuit breaker which permits gasses to vent from the circuit breaker.

It is another object of the present invention to provide a shielding component for a circuit breaker which directs gasses to venting from the circuit breaker in a particular direction.

It is a further object of the present invention to provide a shielding component for a circuit breaker which prevents an arc from shorting to a breaker panel or other enclosure.

It is yet a further object of the present invention to provide a shielding component which protects a mechanism of the circuit breaker from debris generated by arcing between the contacts.

Objects of the invention may be achieved by providing a circuit breaker that includes contacts configured to touch when closed and separate when opened; a mechanism configured to open and close the contacts; a housing enclosing the mechanism and the contacts; an opening in the housing to permit a gas to escape the housing; and, a shield attached to the housing; where the shield includes an exterior portion defining a space around the opening that is external to the housing; and, where the exterior portion includes an outlet and is disposed to direct the gas from the opening toward the outlet.

In some implementations, the circuit breaker also includes a second housing and a second opening in the second housing to permit a gas to escape the second housing; where the shield is attached to the second housing; and where the shield includes a second exterior portion defining a second space around the second opening that is external to the second housing; and, where the second exterior portion includes a second outlet and is disposed to direct the gas from the second opening toward the second outlet. Optionally, the exterior portion and the second exterior portion are integral with the shield.

In some implementations, the shield is connected to the housing a fastener. The shield may include an electrical insulator, and may be made from a thermoplastic resin.

In some implementations, the shield also includes a terminal cover. Optionally, the terminal cover is integral with the shield. Optionally, the terminal cover is connected to the shield by a living hinge.

In some implementations, the shield also includes an interior portion extending into the housing. Optionally, the housing includes a mechanism area partially enclosing the mechanism and a contact area partially enclosing the contacts; and, the interior portion partially separates the mechanism area from the contact area.

In some implementations, the circuit breaker includes a movable arm configured to separate the mechanism and the contacts. Optionally, the movable arm separates the mechanism and the contacts by abutting, overlapping, or otherwise cooperating with the interior portion.

In some implementations, the interior portion and the exterior portion are one assembly or are one piece.

In some implementations, the housing includes a mechanism area partially enclosing the mechanism and a contact area partially enclosing the contacts; and, the interior portion partially separates the mechanism area from the contact area.

In some implementations, the housing includes two half-shells which form a cavity therebetween. Optionally, the shield is retained between the two half-shells. Optionally, one of the two half-shells includes a channel in which the shield is retained. Optionally, one of the two half-shells includes a channel through which the shield passes. Optionally, a geometric feature of the shield engages one of the two half-shells, retaining the shield in the housing. Optionally, one of the two half-shells includes a channel having one or more channel angles; and, the shield includes an extending portion having one or more shield angles corresponding to the channel angles and which passes through the channel from an exterior of the housing to an interior of the housing. Optionally, the extending portion mates with the channel and is retained in the channel. In some implementations, the housing includes two slots and the shield includes two legs passing through the slots from an exterior of the housing through to an interior of the housing. In some implementations, a terminal engages with the shield.

In some implementations, a terminal having a tab engages a slot in the shield.

Other objects of the invention are achieved by providing a circuit breaker that includes contacts configured to touch when closed and separate when opened; a mechanism configured to open and close the contacts; a housing including two half shells which define a mechanism area partially enclosing the mechanism and a contact area partially enclosing the contacts; a vent configured to permit gasses to escape the housing; and, a shield attached to the housing which includes an exterior portion defining a space around the vent and an outlet.

Other objects of the invention and its particular features and advantages will become more apparent from consideration of the following drawings and accompanying detailed description.

DETAILED DESCRIPTION OF THE INVENTION

Figure 1:
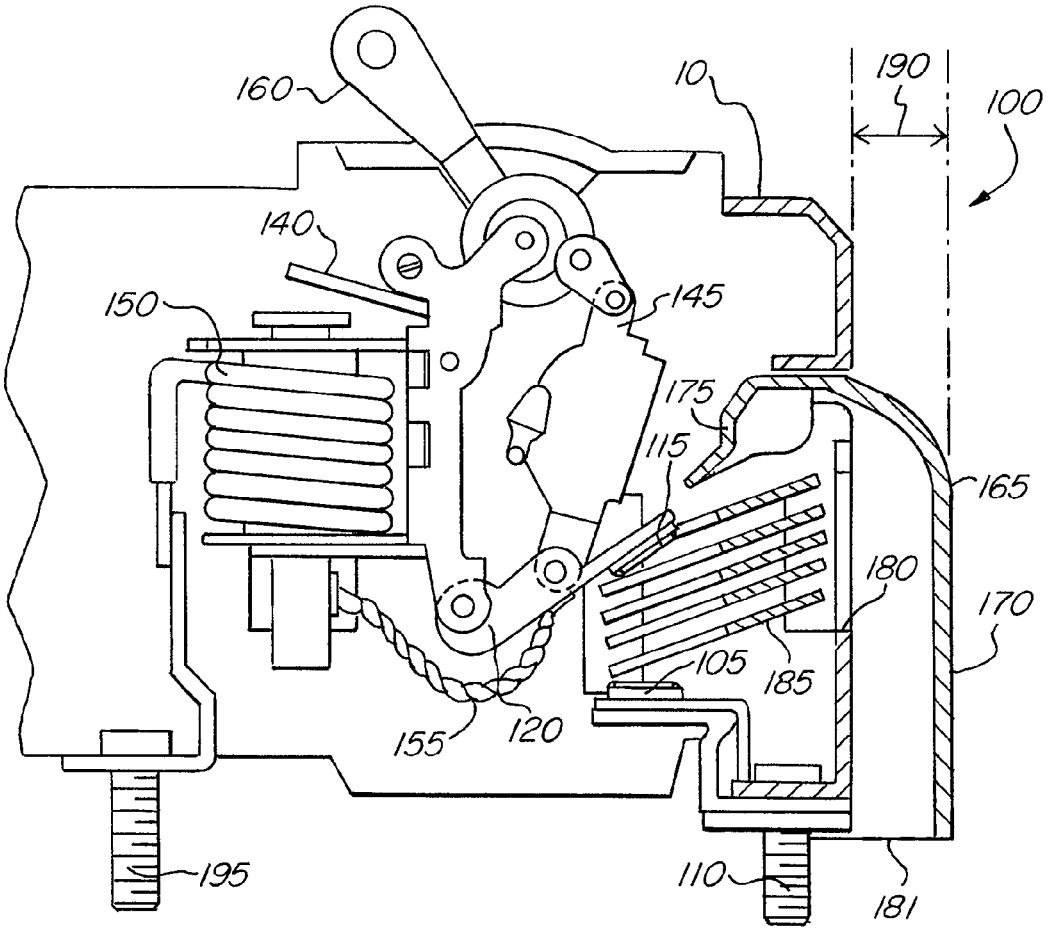
FIG. 1 is a cross-sectional view of a circuit breaker having a shielding component according to aspects of the invention.

FIG. 1 illustrates an example circuit breaker 100 having a shielding component 165 according to aspects of the invention.

Circuit breaker 100 includes a stationary contact 105 connected to a line terminal 110. The line terminal receives electricity from a power source such as a generator (not shown), which in some applications is supplied by a power company.

A movable contact 115 is disposed on a movable contact arm 120 which can be moved between a closed position and an open position. In FIG. 1, contact arm 120 is shown in an open position, with movable contact 115 separated from stationary contact 105.

The movable contact arm 120 is connected to a tripping mechanism 140 by a linkage 145. The linkage may include a spring mechanism (not shown), which is biased to move the movable contact arm from the closed position to an open position when tripping mechanism 140 is tripped.

A fault detector 150 is configured to activate the tripping mechanism 140 when a fault condition occurs, such as excess current. In some applications, the fault detector is a solenoid. In this example, if the current through the solenoid exceeds a certain level, the solenoid generates an electromagnetic field sufficient to activate the tripping mechanism 140. The solenoid may also optionally incorporate a plunger or other armature which activates the tripping mechanism when the current exceeds a certain level.

It is understood that other fault detection methods may also be employed, which trip the tripping mechanism 140 upon the occurrence of a specific condition.

Movable contact 115 is connected to load terminal 195 through fault detector 150 and connector 155. When movable contact 115 is in a closed position (not shown), stationary contact 105 and moveable contact 115 are in contact with each other, and electricity can flow from line terminal 110 to load terminal 195 through contacts 105 and 115.

A handle 160 is also provided for resetting the tripping mechanism 140 and for returning movable contact 115 to the closed position, or for manually tripping the tripping mechanism 140 and for moving movable contact 115 to an open position.

Arc chute 185 includes a plurality of spaced arc plates, and is configured to divide and quench an arc arising between contacts 105 and 115.

Vent 180 is disposed on a side of the arc chute 185 opposite contacts 105 and 115. Vent 180 may be constructed as an opening or openings in the housing 10 of circuit breaker 100.

In an example operation, an arc (not shown) generated between contacts 105 and 115 is drawn into the arc chute 185 and quenched. In some applications, a magnetic or electromagnetic element (not shown) may deflect the arc into the arc chute 185. Gasses and contact debris generated by the arc can filter through the plates of the arc chute 185 and exit through vent 180.

In practical applications of the example circuit breaker 100, the location of vent 180 may be constrained by design considerations such as the geometry and composition of the circuit breaker housing 10 and any breaker box or other enclosure (not shown) within which the circuit breaker 100 is installed.

Under some conditions, vent 180 can provide a pathway for an arc to short to the breaker box through the vent 180 if the potential between a contact and the breaker box exceeds the breakdown voltage between them, and/or exceeds the ability of the arc chute to interrupt the arc, for example. This situation can occur under various conditions such as a severe overcurrent, inadequate spacing between the vent and surfaces of the breaker box, or the presence of suspended particulate matter or ionized gasses creating a conducting path from a contact to the breaker box.

To address the problem of arc shorting via the vent 180, among other purposes, a shielding component 165 includes an arc shield 170 which extends over vent 180 at a distance 190 from vent 180. Arc shield 170 defines a space between the housing 10 of circuit breaker 100, and arc shield 170, and is enclosed such that gasses exiting vent 180 are directed toward an outlet 181. Arc shield 170, can provide several benefits.

In one example application, arc shield 170 prevents circuit breaker 100 from being installed in a breaker box (not shown) in a position where the vent 180 would be blocked. This can have the advantage of ensuring that gasses can vent from circuit breaker 100.

In another example application, arc shield 170 also prevents circuit breaker 100 from being installed within a breaker box (not shown) in a position where the contacts 105, 115 or arc chute 185 would be closer than distance 190 to a surface of the breaker box. This can have the advantage of reducing the danger of an arc between contacts 105, 115 and the surface of the breaker box by increasing the breakdown voltage between these components. This is because breakdown voltage is positively related to distance under the pressure and voltage conditions in typical applications. Distance 190 can be designed according to the requirements of a specific application, or may be selected to conform the minimum distance between live elements and the breaker box (not shown) specified in applicable standards, such as are promulgated by the National Electrical Manufacturers Association™ (NEMA™), Underwriters Laboratories™ (UL™), Canadian Standards Association™ (CSA™), National Fire Protection Association™ (NFPA™), or other standards or specifications known in the art for circuit breaker enclosure geometries. In an example application, distance 190 is 0.5 inches.

In a further example application, arc shield 170 also prevents circuit breaker 100 from being installed in a breaker box (not shown) in a position where the vent 180 would be closer than the distances defining the exterior space to objects other than circuit breaker 100 and arc shield 170. This can have the advantage of enabling space for vented gasses to escape, expand, diffuse, cool, and/or dilute, preventing damage to surrounding structures from the gasses or from arcing via a conductive path formed by undiffused vent gasses or particulate matter.

In another further example application, arc shield 170 can have the advantage of permitting a larger opening for vent 180 than would otherwise be possible, because the arc shield 170 acts as an additional insulative barrier against an arc shorting to an external object such as a breaker box or other enclosure (not shown).

In yet another example application, arc shield 170 can have the advantage of directing gasses and/or particulate debris exiting vent 180 to a non-hazardous area through outlet 181.

To address the problem of damage from arc-generated contact debris, among other purposes, shielding component 165 may also include a mechanism shield 175 disposed to prevent or impede debris from migrating into the linkage 145, tripping mechanism 140, and other parts of circuit breaker 100.

The mechanism shield 175 is configured within circuit breaker 100 such that when the movable contact arm 120 is in an open position, the mechanism shield 175 and the movable contact arm 120 cooperate to partially or fully isolate the linkage 145, tripping mechanism 140, and other parts of circuit breaker 100 from the contacts 105, 115, arc chute 185, and the general area within circuit breaker 100 where arcing and debris generated by arcing occurs.

When movable contact arm 120 is in the open position, mechanism shield 175 and movable contact arm 120 may cooperate to partially or fully isolate the linkage 145, tripping mechanism 140, and other parts of circuit breaker 100 from the contacts 105, 115, arc chute 185, and the general area within circuit breaker 100 where arcing and debris generated by arcing occurs by abutting, overlapping, or lying adjacent to or near one another, or by meeting at the vertex of an angle formed by mechanism shield 175 and movable contact arm 120. In some implementations, movable contact arm 120 touches mechanism shield 175 when it is in an open position. In other implementations, moveable contact arm 120 terminates near mechanism shield 175 without touching.

During an example fault condition, contacts 105 and 115 are separated by the operation of circuit breaker 100. Portions of circuit breaker 100 which contain moving parts and other mechanisms required for the operation of circuit breaker 100 are protected from the portions of circuit breaker 100 where arcing and debris are created by the mechanism shield 175 in cooperation with contact arm 120.

In some implementations, arc shield 170 and mechanism shield 175 may be constructed as one piece, i.e. shielding component 165. This can have the advantage of enabling these parts to be easily assembled with circuit breaker 100 or easily supplied as an upgrade or replacement part for circuit breaker 100. In another implementation, arc shield 170 and mechanism shield 175 may be incorporated into one assembly or sub-assembly.

Figure 2:
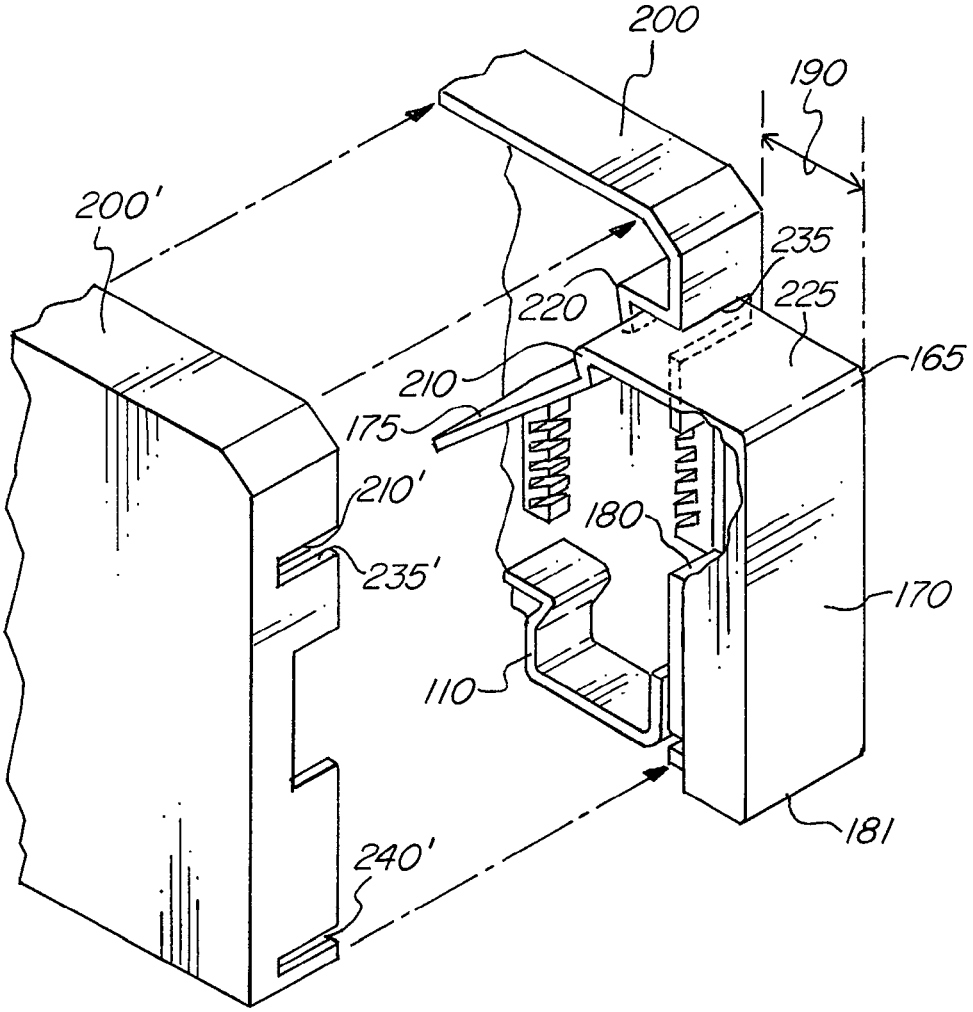
FIG. 2 is an exploded view of portions of the circuit breaker shown in FIG. 1.

FIG. 2 is an exploded view of the circuit breaker shown in FIG. 1 showing the shielding component 165 and surrounding structures, which illustrates aspects of the invention.

Shielding component 165 is shown as one piece forming arc shield 170 and mechanism shield 175. In some implementations, the shielding component includes upper leg 225.

Arc shield 170 is shown partially cut-away to illustrate vent 180 which is shielded by arc shield 170 in such a way as to form a duct. Gasses (not shown) exiting housing 10 through vent 180 are directed toward an outlet 181 of the duct formed by arc shield 170.

Half shells 200, 200' can be assembled as shown to form housing 10. In various implementations, shielding component 165 is retained between half shells 200, 200'.

In some implementations, upper leg 225 may extend into housing 10 through a slot 235 in half-shell 200. In some implementations, a geometric feature 210 of shielding component 165 interacts with a geometric feature 220 of half shell 200 to retain shielding component 165 within housing 10. Geometric feature 210 may include a bend, angle, or series of bends or angles in shielding component 165. Geometric feature 220 may include a bend, angle, or series of bends or angles in half-shell 200 which mate with or otherwise correspond to geometric feature 210. Geometric feature 220 may alternatively or additionally include a channel molded or cut into half-shell 200 which includes bends, angles, or a series of bends or angles corresponding to geometric feature 210.

Various configurations of geometric features 210 and 220 can be used to retain shielding component 165 within housing 10 without departing from the invention. Optionally, screws, tabs, or other retaining means (not shown) may be used to retain shielding component 165 within housing 10.

Half-shell 200' may include various structures corresponding to half-shell 200. For example, geometric feature 210', and slot 235' may each correspond to geometric feature 210, and slot 235 of half-shell 210, respectively. These structures are situated such that when half-shells 210, 210' are assembled, they align. In some implementations, shielding component 165 is retained within the resulting structures.

In other implementations, half-shell 210' does not include corresponding structures to half-shell 210, but is simply a cover (not shown). In these implementations, shielding component 165 is retained within the structures of half-shell 210 by the cover.

Figure 3:
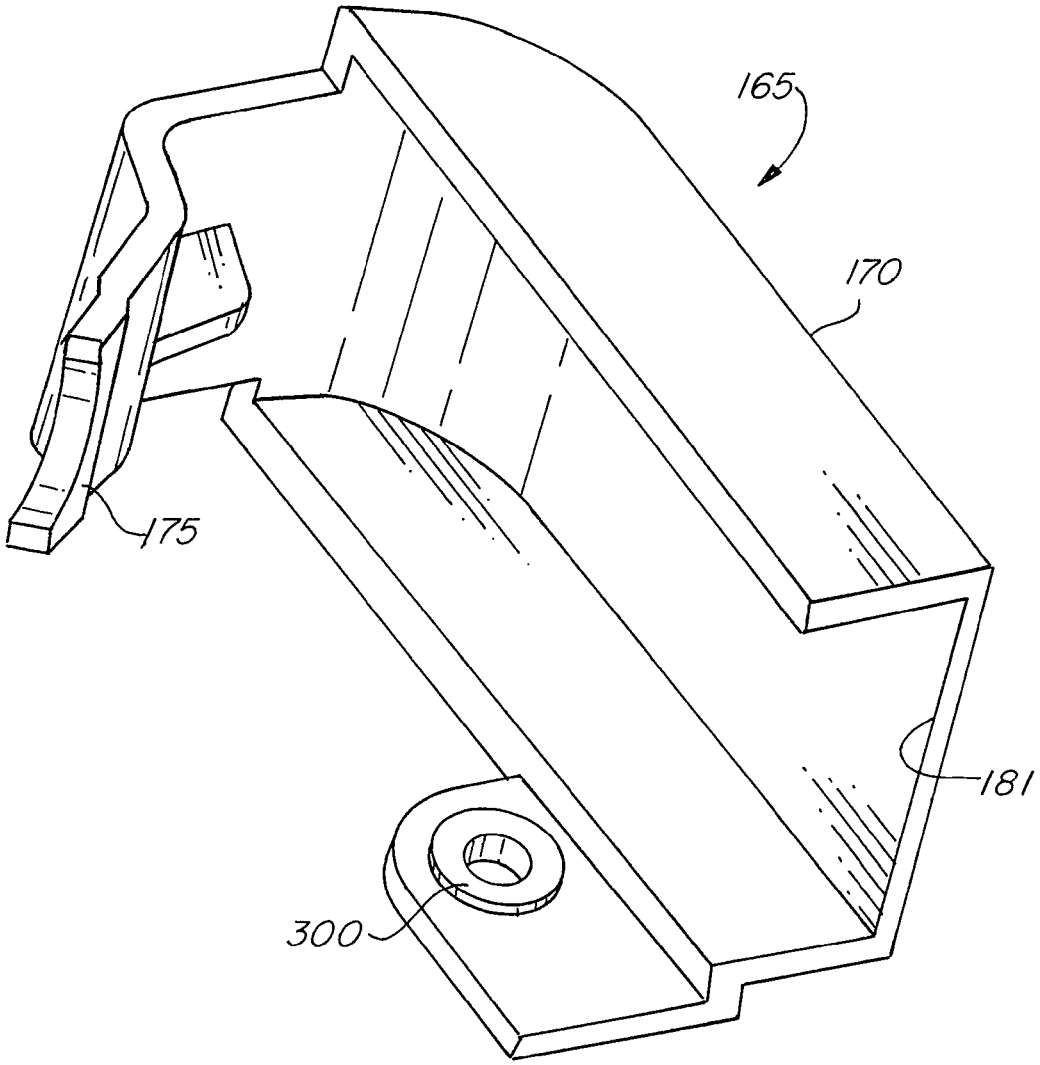
FIG. 3 is a perspective view of a shielding component shown in FIGS. 1 and 2.

FIG. 3 is a perspective view of shielding component 165 which further illustrates arc shield 170, mechanism shield 175, and outlet 181. Also shown is fastener sleeve 300, which in some implementations may be used to attach or to assist in attaching shielding component 165 to housing 10.

Figure 4:
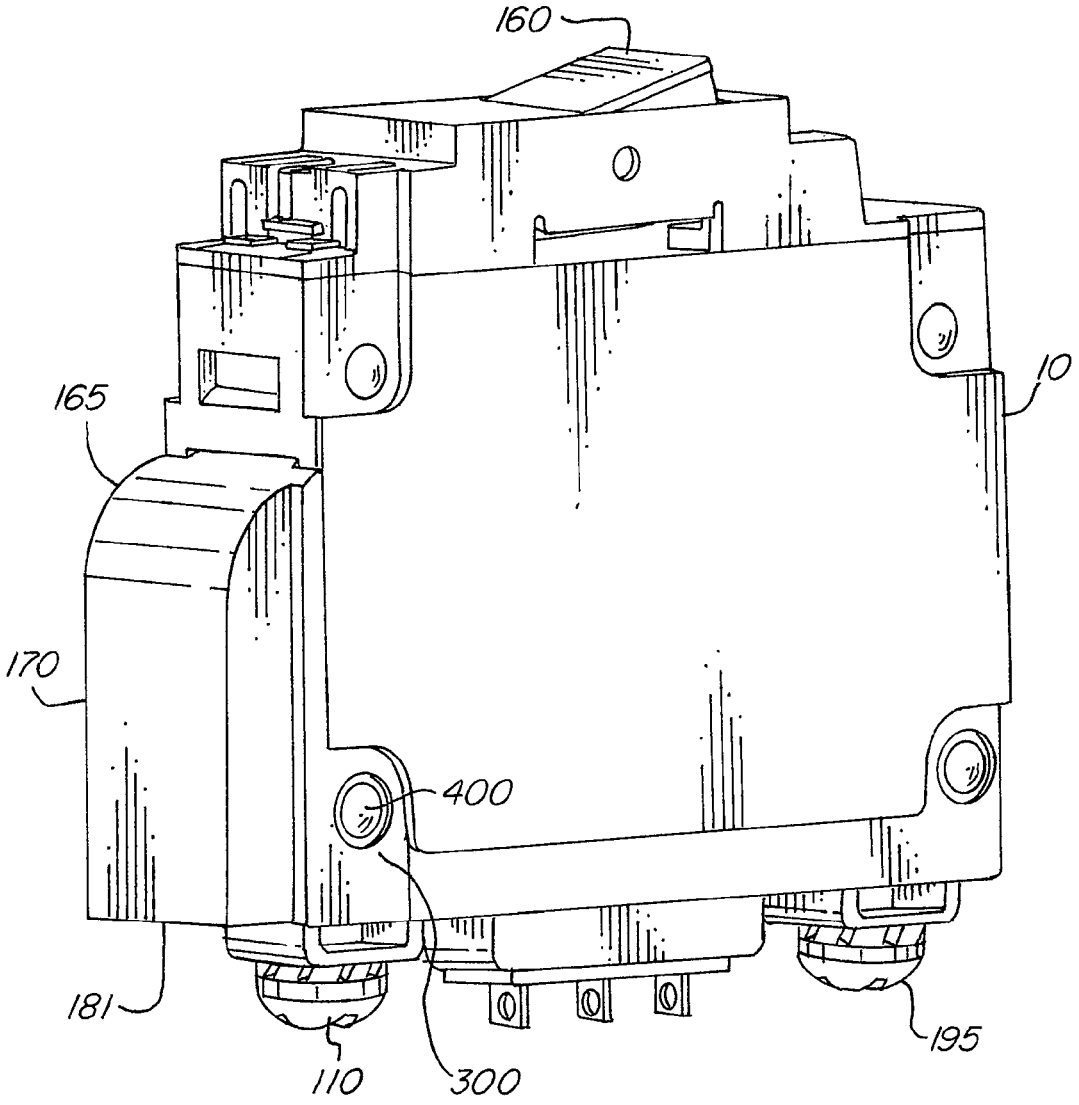
FIG. 4 is a perspective view of the shielding component attached to a housing as shown in FIGS. 1-3.

FIG. 4 is a perspective view showing shielding component 165 attached to housing 10 using a fastener 400 installed through fastener sleeve 300. Those having skill in the art will appreciate that there may be other ways of connecting shielding component 165 to housing 10 without departing from aspects of the invention.

Figure 5:
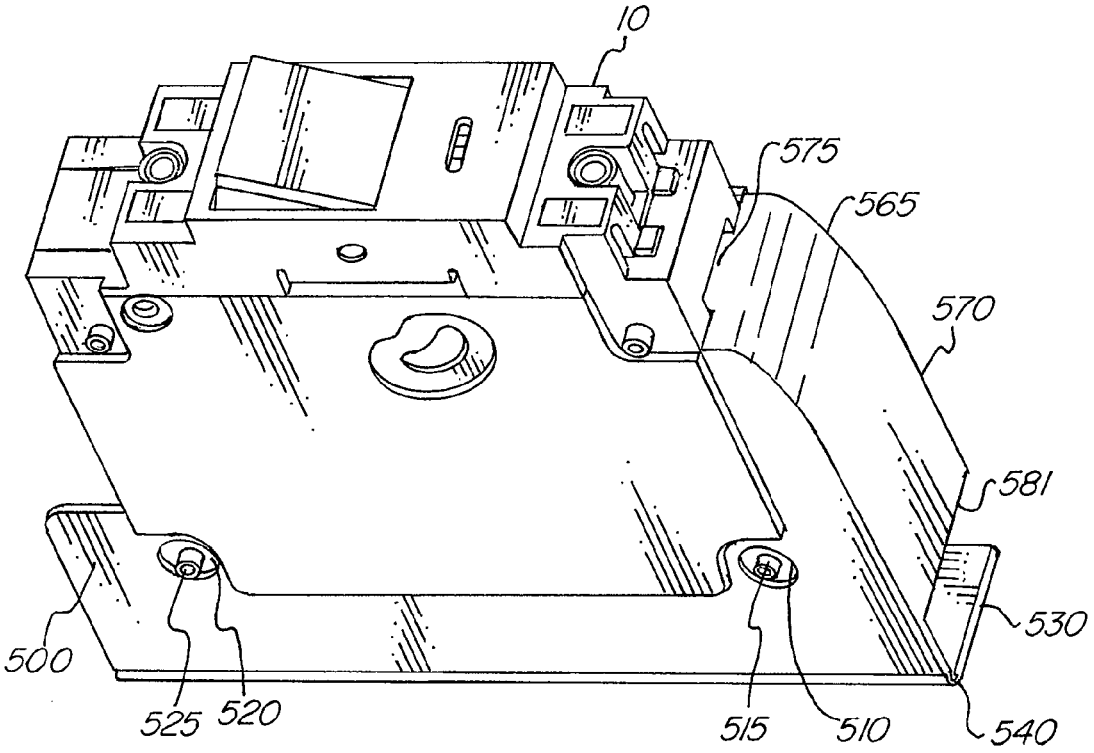
FIG. 5 is a perspective view of the shielding component attached to a housing as shown in FIGS. 1-4, including additional components.

FIG. 5 is a perspective view illustrating the shielding component including additional features according to aspects of the invention.

Shielding component 565 includes an arc shield 570, mechanism shield 575, and outlet 581. These elements are essentially identical to arc shield 170, mechanism shield 175, and outlet 181 described above regarding FIGS. 1-4. In addition, shielding component 565 includes an extending portion 500.

Extending portion 500 includes a fastener sleeve 510, which is similar to fastener sleeve 300, described regarding FIGS. 3 and 4, as well as an additional fastener sleeve 520, through which fasteners 515 and 525 are installed to attach shielding component 565 to housing 10.

Extending portion 500 also includes a terminal shield 530 which extends at an angle from other portions of extending portion 500 via a living hinge 540. A living hinge is a thin flexible hinge made from the same material as the pieces it connects. Typically, it is thinned or cut to allow the pieces to bend along the line of the living hinge. In some implementations, this means that the extending portion 500 and terminal shield 530 are molded as one piece, and folded over along living hinge 540. In some implementations, the terminal shield may include a separate component (not shown) that is attached to extending portion 500 using a method known in the art.

Figure 6:
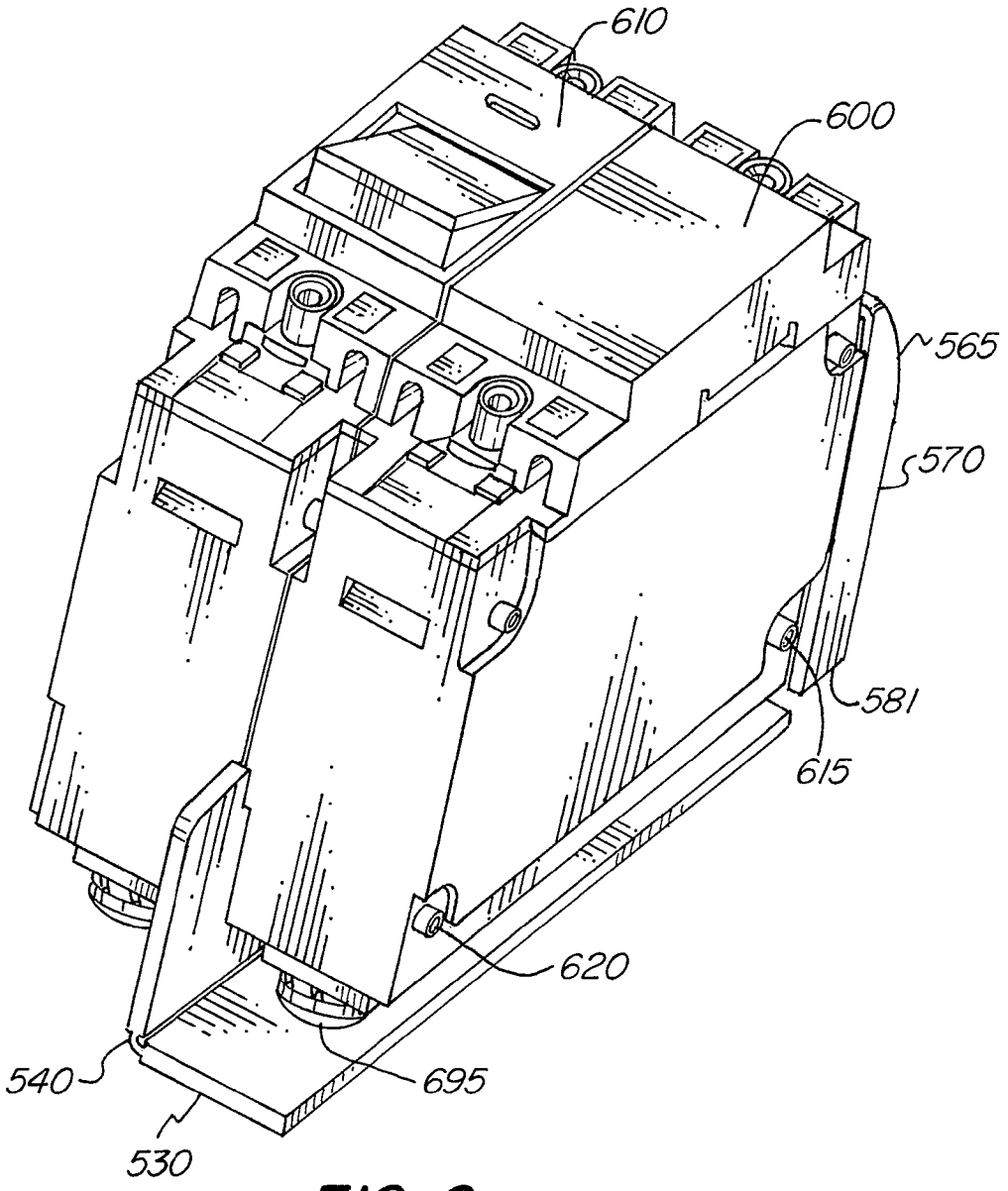
FIG. 6 is a perspective view of the shielding component attached to a housing as shown in FIGS. 1-4, including additional components.

FIG. 6 illustrates shielding component 565 as attached between a circuit breaker 600 and a second circuit breaker 610. Shielding component 565 may be held in place between breaker 600 and breaker 610 using fasteners 615, 620 that pass through corresponding fastener sleeves in circuit breaker 600. Optionally, fasteners 615 and/or 620 may pass through second circuit breaker 610, or both 600 and 610.

Terminal shield 530 is shown extending over terminal 695. This can have the advantage of protecting terminal 695 from inadvertently contacting a surface within a breaker box, for example, or of preventing a user from inadvertently touching terminal 695.

Figure 7:
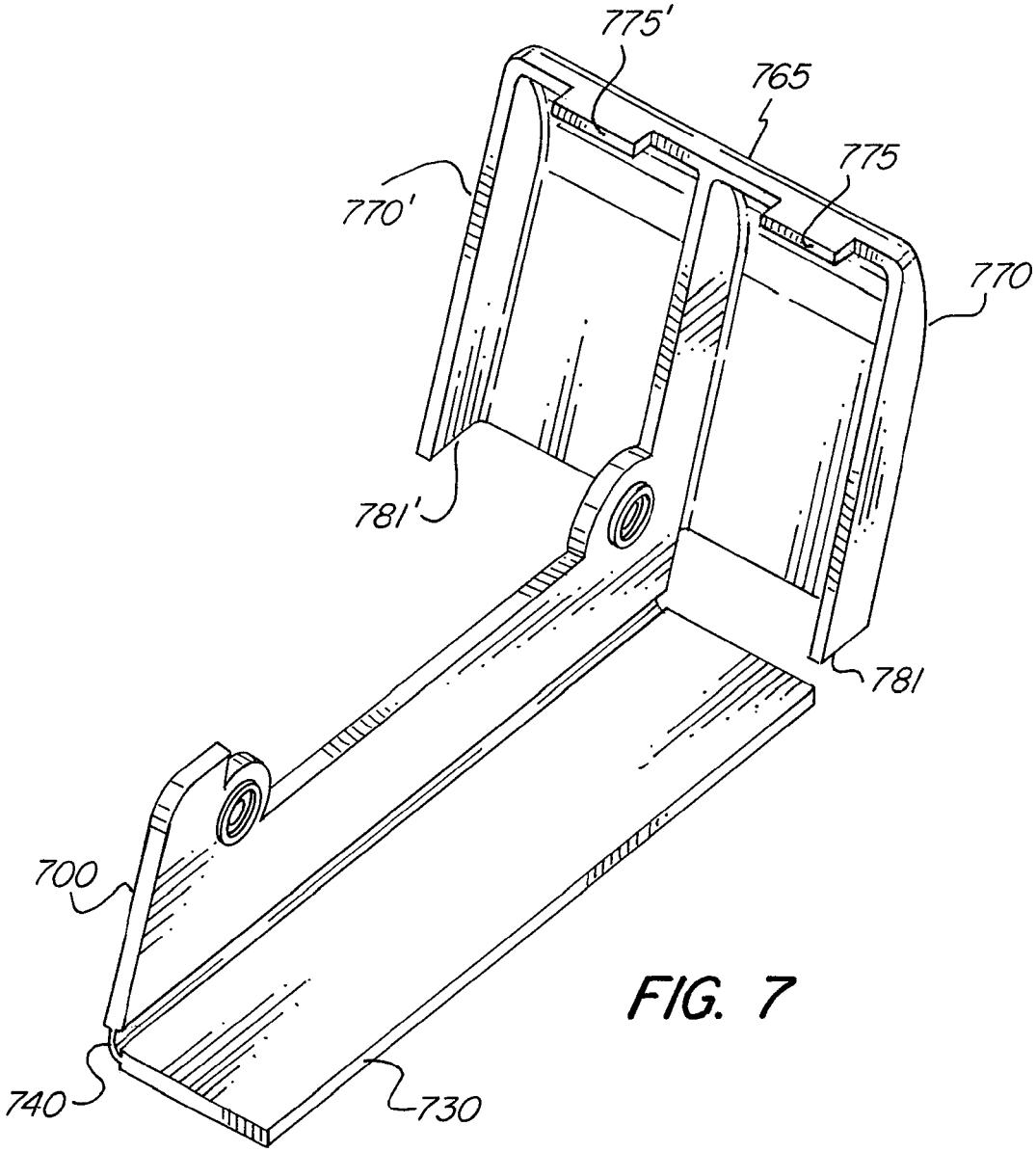
FIGS. 7 and 8 illustrate the shielding component as shown in FIGS. 1-4, including additional components.
Figure 8:
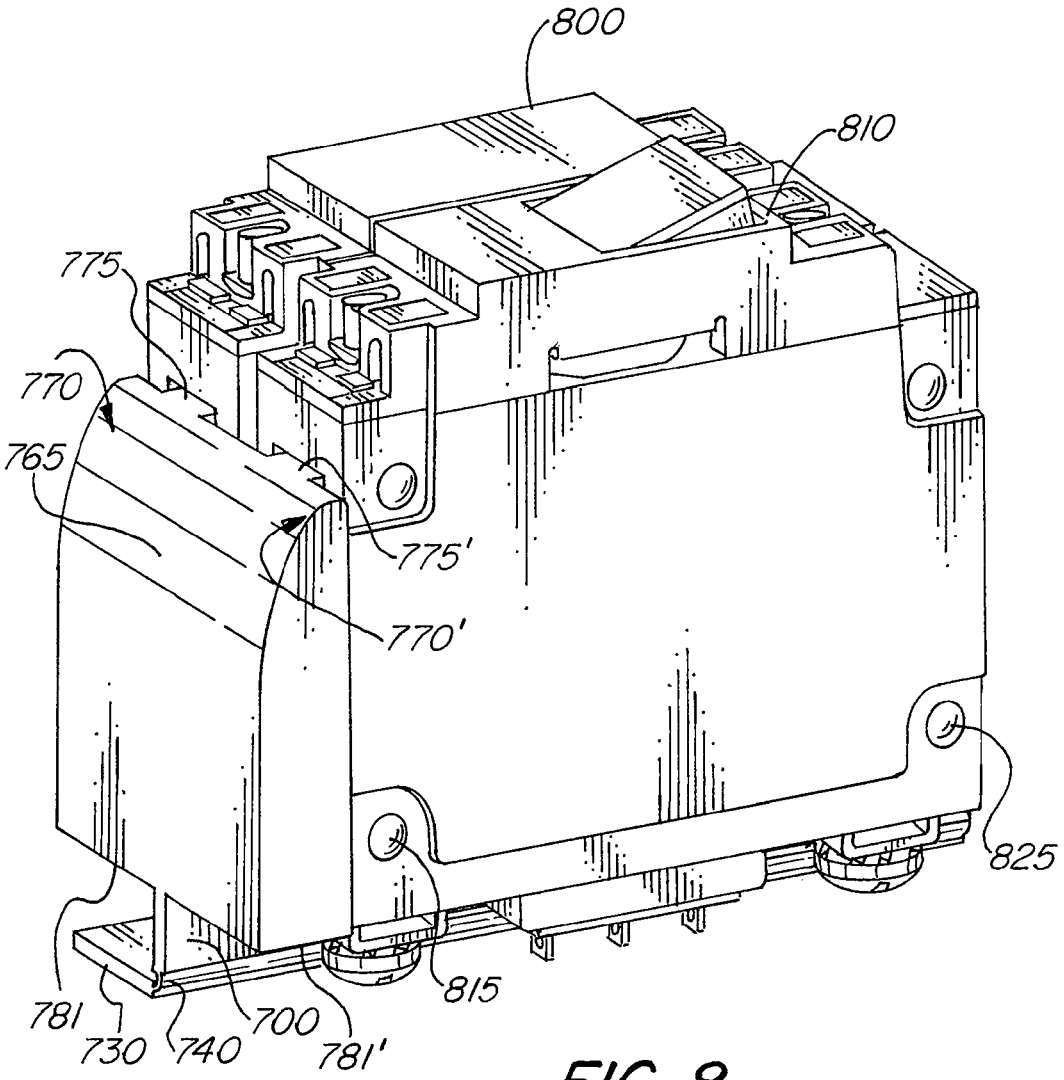

FIGS. 7 and 8 illustrate further added features for a shielding component according to aspects of the invention.

Shielding component 765 includes an arc shield 770, outlet 781, extending portion 700, terminal shield 730, and living hinge 740. These components are substantially similar to arc shield 570, outlet 581, extending portion 500, terminal shield 530, and living hinge 540 described regarding FIG. 5.

In addition, shielding component 765 includes a second arc shield 770' and second outlet 781'. Second arc shield 770' and second outlet 781' are shown formed as one piece with arc shield 770 and outlet 781, however, in some embodiments these may be separate pieces that are joined together.

Shielding component 765 also includes insert tabs 775, 775'. However, in some implementations, insert tabs 775, 775' may be replaced with mechanism shields similar to mechanism shield 175 as described with respect to FIGS. 1-4.

FIG. 8 illustrates shielding component 765 as attached between a circuit breaker 800 and a second circuit breaker 810. Shielding component 765 may be held in place between breaker 800 and breaker 810 using elongated fasteners 815, 825 that pass through corresponding fastener sleeves in circuit breaker 800, second circuit breaker 810, or both. Insert tabs 775, 775' align or retain shielding component 765

Arc shields 775 and 775' extend over vents (not shown) in circuit breaker 800 and 810 respectively in the same manner as arc shield 170 and vent 180 described with respect to FIGS. 1-4.

Terminal shield 730 extends over terminals (not shown) of circuit breaker 800 in a manner similar to terminal shield 530 as described with respect to FIG. 5. In some implementations, a terminal shield (not shown) may extend over terminals of circuit breaker 810.

Although the invention has been described with reference to a particular arrangement of parts, features and the like, these are not intended to exhaust all possible arrangements or features, and indeed many modifications and variations will be ascertainable to those of skill in the art.

What is claimed is:

1. A circuit breaker comprising:

contacts configured to be touching when closed and be separated when opened;

a mechanism configured to open and close the contacts;

a housing enclosing the mechanism and the contacts;

an opening in the housing adapted to permit a gas to escape the housing; and, a shield attached to the housing;

wherein the shield comprises an exterior portion defining a space around the opening that is external to the housing;

wherein the exterior portion comprises an outlet and is disposed to direct the gas from the opening toward the outlet; and wherein the housing includes at least one slot and the shield includes at least one leg passing through the at least one slot from an exterior of the housing through to an interior of the housing.

2. The circuit breaker of claim 1, further comprising a second housing;

a second opening in the second housing adapted to permit a gas to escape the second housing;

wherein the shield is attached to the second housing;

wherein the shield comprises a second exterior portion defining a second space around the second opening that is external to the second housing; and, wherein the second exterior portion comprises a second outlet and is disposed to direct the gas from the second opening toward the second outlet.

3. The circuit breaker of claim 2, wherein the exterior portion and the second exterior portion are integral with the shield.

4. The circuit breaker of claim 1, wherein the shield further comprises a terminal cover.

5. The circuit breaker of claim 4, wherein the terminal cover is integral with the shield.

6. The circuit breaker of claim 4, wherein the terminal cover is connected to the shield by a living hinge.

7. The circuit breaker of claim 1, wherein the shield is connected to the housing using a fastener.

8. The circuit breaker of claim 1, wherein the shield further comprises an interior portion extending into the housing.

9. The circuit breaker of claim 8, wherein the housing comprises a mechanism area partially enclosing the mechanism and a contact area partially enclosing the contacts; and, the interior portion partially separates the mechanism area from the contact area.

10. The circuit breaker of claim 1, wherein the shield comprises an electrical insulator.

11. The circuit breaker of claim 1, wherein the shield comprises a thermoplastic resin.

12. The circuit breaker of claim 8, further comprising a movable arm, configured to separate the mechanism and the contacts by cooperating with the interior portion.

13. The circuit breaker of claim 8, further comprising a movable arm configured to separate the mechanism and the contacts by abutting the interior portion.

14. The circuit breaker of claim 8, further comprising a movable arm configured to separate the mechanism and the contacts by overlapping the interior portion.

15. The circuit breaker of claim 8, wherein the interior portion and the exterior portion comprise one assembly.

16. The circuit breaker of claim 8, wherein the interior portion and the exterior portion are one single integral piece.

17. The circuit breaker of claim 8, wherein the housing comprises a mechanism area partially enclosing the mechanism and a contact area partially enclosing the contacts; and, the interior portion partially separates the mechanism area from the contact area.

18. The circuit breaker of claim 1, wherein the housing comprises two half-shells which form a cavity therebetween.

19. The circuit breaker of claim 18, wherein the shield is retained between the two half-shells.

20. The circuit breaker of claim 18, wherein one of the two half-shells comprises a channel in which the shield is retained.

21. The circuit breaker of claim 18, wherein one of the two half-shells comprises a channel through which the shield passes.

22. The circuit breaker of claim 18, wherein a geometric feature of the shield engages one of the two half-shells, retaining the shield in the housing.

23. The circuit breaker of claim 18, wherein one of the two half-shells includes a channel having one or more channel angles; and, the shield includes an extending portion having one or more shield angles corresponding to the channel angles and which passes through the channel from an exterior of the housing to an interior of the housing.

24. The circuit breaker of claim 23, wherein the extending portion mates with the channel and is retained in the channel.

25. The circuit breaker of claim 1, wherein the housing includes two slots and the shield includes two legs passing through the slots from an exterior of the housing through to an interior of the housing.

26. The circuit breaker of claim 1, further comprising a terminal engaged with the shield.

27. The circuit breaker of claim 1, further comprising a terminal having a tab which engages a slot in the shield.

28. A circuit breaker comprising:

contacts configured to be touching when closed and be separated when opened;

a mechanism configured to open and close the contacts;

a housing comprising two half shells which define a mechanism area partially enclosing the mechanism and a contact area partially enclosing the contacts;

a vent configured to permit gasses to escape the housing;

a shield attached to the housing which includes an exterior portion defining a space around the vent and an outlet; and wherein the housing includes at least one slot and the shield includes at least one leg passing through the at least one slot from an exterior of the housing through to an interior of the housing.

29. A circuit breaker comprising:

contacts configured to be touching when closed and be separated when opened;

a mechanism configured to open and close the contacts;

a housing enclosing the mechanism and the contacts;

an opening in the housing adapted to permit a gas to escape the housing; and, a shield attached to the housing;

wherein the shield comprises an exterior portion defining a space around the opening that is external to the housing;

wherein the exterior portion comprises an outlet and is disposed to direct the gas from the opening toward the outlet;

wherein the housing comprises two half-shells which form a cavity therebetween;

wherein one of the two half-shells includes a channel having one or more channel angles; and, wherein the shield includes an extending portion having one or more shield angles corresponding to the channel angles and which passes through the channel from an exterior of the housing to an interior of the housing.

30. The circuit breaker of claim 29, wherein the extending portion mates with the channel and is retained in the channel.

31. A circuit breaker comprising:

contacts configured to be touching when closed and be separated when opened;

a mechanism configured to open and close the contacts;

a housing enclosing the mechanism and the contacts;

an opening in the housing adapted to permit a gas to escape the housing; and, a shield attached to the housing;

wherein the shield comprises an exterior portion defining a space around the opening that is external to the housing;

wherein the exterior portion comprises an outlet and is disposed to direct the gas from the opening toward the outlet; and, wherein the housing includes two slots and the shield includes two legs passing through the slots from an exterior of the housing through to an interior of the housing.

* * * * *